US012096871B2

(12) United States Patent
Li

(10) Patent No.: US 12,096,871 B2
(45) Date of Patent: Sep. 24, 2024

(54) HOOK ASSEMBLY AND SHELVING ASSEMBLY USING THE SAME

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 550 days.

(21) Appl. No.: 17/295,810

(22) PCT Filed: Apr. 1, 2021

(86) PCT No.: PCT/CN2021/084831
§ 371 (c)(1),
(2) Date: May 20, 2021

(87) PCT Pub. No.: WO2022/165971
PCT Pub. Date: Aug. 11, 2022

(65) Prior Publication Data

US 2023/0157469 A1 May 25, 2023

(30) Foreign Application Priority Data

Feb. 5, 2021 (CN) ..... 202110161015.6

(51) Int. Cl.
*A47G 25/06* (2006.01)
*A47B 47/02* (2006.01)
*A47B 96/02* (2006.01)

(52) U.S. Cl.
CPC ..... *A47G 25/0678* (2013.01); *A47B 47/022* (2013.01); *A47B 96/027* (2013.01)

(58) Field of Classification Search
CPC .. A47G 25/0678; A47G 29/00; A47B 47/022; A47B 96/027; A47B 55/02; A47F 5/0006; A47F 5/103
See application file for complete search history.

(56) References Cited

U.S. PATENT DOCUMENTS 5,351,842 A * 10/1994 Remmers ..... A47B 96/028 108/29
5,531,416 A * 7/1996 Remmers ..... A47G 25/0692 248/222.51

(Continued)

FOREIGN PATENT DOCUMENTS

CN 2706090 Y 6/2005
CN 2827122 Y 10/2006

(Continued)

*Primary Examiner* — Hanh V Tran
(74) *Attorney, Agent, or Firm* — FITCH, EVEN, TABIN & FLANNERY LLP

(57) ABSTRACT

The present application discloses a hook assembly, which is used to be connected to a densely gridded rack. The hook assembly of the present application comprises a main body and a top connecting portion, wherein the main body and the top connecting portion are fixedly connected, and the top connecting portion is configured to be detachably connected to the rack. The width of the top connecting portion is greater than the spacing between adjacent longitudinal metal wires. The top connecting portion is provided with a receiving groove, the receiving groove is provided along the length direction of the top connecting portion, and the receiving groove is configured to receive a longitudinal metal wire. The shelving assembly provided in the present application can be reliably connected to the densely gridded rack without reducing the width of a top plate, so as to avoid the interference of the longitudinal metal wires. Most of the sizes of the shelving assembly remain unchanged, so as to solve the technical problems existing in the prior art with (Continued)

minimal modification and cost. It is also possible to increase the width of the top connecting portion to further improve the load-bearing capacity of the shelving assembly.

20 Claims, 9 Drawing Sheets

(56) References Cited

U.S. PATENT DOCUMENTS

| | | | | |
|---|---|---|---|---|
| 5,580,018 | A * | 12/1996 | Remmers | A47B 55/02 211/90.01 |
| 5,752,610 | A * | 5/1998 | Remmers | A47F 5/13 211/186 |
| 7,516,930 | B2 * | 4/2009 | Chen | F16B 45/00 248/304 |
| 7,946,549 | B2 * | 5/2011 | Forrest | A47F 5/0068 248/249 |
| 9,326,604 | B1 * | 5/2016 | Schuldt | A47B 96/021 |
| 2005/0150436 | A1 * | 7/2005 | Marchetta | A47B 96/028 108/108 |
| 2005/0150850 | A1 * | 7/2005 | Stitchick | A47B 47/022 211/90.03 |
| 2005/0230577 | A1 * | 10/2005 | Chen | A47B 61/003 248/304 |
| 2006/0011570 | A1 * | 1/2006 | Chen | A47F 5/0006 211/183 |
| 2006/0261230 | A1 * | 11/2006 | Lee | A47B 61/003 248/304 |
| 2007/0108146 | A1 * | 5/2007 | Nawrocki | F16B 12/38 211/90.03 |
| 2007/0241253 | A1 * | 10/2007 | Chen | F16B 45/00 248/304 |
| 2011/0155677 | A1 * | 6/2011 | Fernandez | A47B 45/00 211/183 |
| 2015/0053632 | A1 * | 2/2015 | Brinton, Jr. | A47B 61/003 248/225.11 |
| 2016/0296010 | A1 * | 10/2016 | Staib | A47B 55/02 |

FOREIGN PATENT DOCUMENTS

| | | | |
|---|---|---|---|
| CN | 2882457 | Y | 3/2007 |
| CN | 2904796 | Y | 5/2007 |
| CN | 208740598 | U | 4/2019 |
| CN | 211154632 | U | 8/2020 |

* cited by examiner

HOOK ASSEMBLY AND SHELVING ASSEMBLY USING THE SAME

CROSS-REFERENCE TO RELATED APPLICATIONS

This application is a U.S. national phase application of International Application No. PCT/CN2021/084831, filed Apr. 1, 2021, which claims priority to Chinese Patent Application No. 202110161015.6, filed Feb. 5, 2021.

FIELD OF THE INVENTION

The present application relates to a connecting mechanism, in particular to a hook assembly and a shelving assembly using the hook assembly.

DESCRIPTION OF THE PRIOR ART

Shelves are commonly used equipment in daily life. Household shelves are usually used to place clothes, daily necessities, etc., and commercial shelves are usually used to place commodities and products. Among them, shelves installed on vertical surfaces are widely used in supermarkets and shopping malls because of their small footprints. A shelf of this kind usually has a plurality of brackets fixedly installed on a vertical wall surface or a board surface, and then a rack is placed horizontally on the brackets to form a shelf. The rack has a grid-like structure, which is composed of a plurality of transverse metal wires provided in parallel and a plurality of longitudinal metal wires provided in parallel interwoven.

In a shelving system, a hook assembly is one of the commonly used shelving assemblies. The hook assembly usually comprises an upper connecting mechanism and a lower hook, wherein the connecting mechanism is used to connect the hook assembly to a rack or a bracket, and the hook is used to hang clothes or a rail. In some prior art, the hook assembly comprises an elongated top, and the top comprises a front hook portion and a rear hook portion. The width of the elongated top is less than the gap between longitudinal metal wires provided in parallel, and the length of the top is equal to the gap between transverse metal wires provided in parallel. When installing, after tilting the top by a certain angle, and passing it through the gap between the longitudinal metal wires from bottom to top, lay the top flat. The front hook portion and the rear hook portion respectively hook a transverse metal wire, so that the hook assembly is fixedly connected to the rack.

With the increase in demand, it is desirable that the shelving system can carry more goods, as well as heavier weight. One of the conventional methods to solve this problem is to use a densely gridded rack. That is, the spacing between adjacent longitudinal metal wires of the rack is reduced. In this case, because the width of the top of the hook assembly in the prior art is larger than the spacing between adjacent longitudinal metal wires, the hook assembly is interfered by the longitudinal metal wires and cannot enter the gap between the longitudinal metal wires. If the width of the top is reduced in order for the hook assembly to enter the gap between the longitudinal metal wires, the strength of the top will be reduced, such that the load-bearing capacity of the hook assembly will be reduced.

Therefore, those skilled in the art devote themselves to developing a hook assembly and a shelving assembly using the hook assembly. In a shelving system that uses a densely gridded rack, the hook assembly can be reliably connected to the densely gridded racks without affecting the load-bearing capacity of the shelving assembly.

SUMMARY OF THE INVENTION

In order to solve the above technical problems, the present application provides a hook assembly, comprising a hook portion and a connecting portion, wherein a first end of the hook portion is fixedly connected to the connecting portion, and the connecting portion is configured to be detachably connected to a rack.

In some embodiments, optionally, the width of the connecting portion is greater than the spacing between adjacent longitudinal metal wires of the rack.

In some embodiments, optionally, the connecting portion is provided with a receiving groove, the receiving groove crosses a first surface of the connecting portion along the length direction of the connecting portion, and the receiving groove is configured to receive the longitudinal metal wire of the rack.

In some embodiments, optionally, the size of the receiving groove matches the diameter of the longitudinal metal wire.

In some embodiments, optionally, there are a plurality of the receiving grooves and their sizes match the longitudinal metal wire, and the spacing between adjacent receiving grooves is equal to the spacing between adjacent longitudinal metal wires.

In some embodiments, optionally, the width of the receiving groove is greater than twice the diameter of the longitudinal metal wire.

In some embodiments, optionally, the receiving groove extends along a front hook portion of the connecting portion, dividing the front hook portion into two parts.

In some embodiments, optionally, the receiving groove extends along a rear hook portion of the connecting portion, dividing the rear hook portion into two parts.

Another object of the present application is to provide a hook assembly, comprising a connecting portion and a hook portion, wherein the connecting portion is fixedly connected to a first end of the hook portion, and the connecting portion is configured to be provided at a joint between a first rack and a second rack provided adjacently.

In some embodiments, optionally, the connecting portion is provided with a receiving groove, the receiving groove is provided along the length direction of the connecting portion and crosses a first surface of the connecting portion, and the receiving groove is configured to receive a first longitudinal metal wire, which is adjacent to the second rack, on the first rack, and a second longitudinal metal wire, which is adjacent to the first rack, on the second rack.

In some embodiments, optionally, the depth of the receiving groove matches the diameters of the first longitudinal metal wire and the second longitudinal metal wire.

In some embodiments, optionally, the width of the receiving groove is greater than the sum of the diameter of the first longitudinal metal wire and the diameter of the second longitudinal metal wire.

Another object of the present application is to provide a shelving assembly, comprising a rack and a hook assembly, wherein the hook assembly is connected to the rack;

the hook assembly comprises a hook portion and a connecting portion, one end of the hook portion is fixedly connected to the connecting portion, a first surface of the connecting portion is provided with a receiving groove along the length direction of the connecting portion, and the receiving groove is used to receive a longitudinal metal wire of the rack; and the connecting portion further comprises a front hook portion and a rear hook portion respectively provided at two ends of the connecting portion in its length direction, and the front hook portion and the rear hook portion are respectively connected to transverse metal wires provided adjacently on the rack.

Another object of the present application is to provide a shelving assembly which comprises:

at least two racks, wherein the at least two racks are provided adjacently; and a hook assembly which is connected to a joint between two adjacent racks;

wherein the hook assembly comprises a hook portion and a connecting portion, one end of the hook portion is fixedly connected to the connecting portion, a first surface of the connecting portion is provided with a receiving groove along the length direction of the connecting portion, and adjacent longitudinal metal wires on the two adjacent racks are located in the receiving groove; and the connecting portion further comprises a front hook portion and a rear hook portion respectively provided at two ends of the connecting portion in its length direction, and the front hook portion and the rear hook portion are configured to be detachably connected to transverse metal wires of the two adjacent racks, respectively.

Another object of the present application is to provide a shelving assembly, comprising a rack, a hook assembly and a hanging rod, wherein the hook assembly is connected to the rack, and the hanging rod is connected to the hook assembly;

the hook assembly comprises a hook portion and a connecting portion, one end of the hook portion is fixedly connected to the connecting portion, a first surface of the connecting portion is provided with a receiving groove along the length direction of the connecting portion, and the receiving groove is used to receive a longitudinal metal wire of the rack;

the connecting portion further comprises a front hook portion and a rear hook portion respectively provided at two ends of the connecting portion in its length direction, and the front hook portion and the rear hook portion are respectively connected to transverse metal wires provided adjacently on the rack; and the hook portion further comprises a lower hook portion provided at a second end thereof, and the lower hook portion is configured to carry the hanging rod.

Another object of the present application is to provide a shelving assembly which comprises:

at least two racks, wherein the at least two racks are provided adjacently; and a hook assembly which is connected to a joint between two adjacent racks;

a hanging rod which is connected to the hook assembly;

wherein the hook assembly comprises a hook portion and a connecting portion, one end of the hook portion is fixedly connected to the connecting portion, a first surface of the connecting portion is provided with a receiving groove along the length direction of the connecting portion, and adjacent longitudinal metal wires on the two adjacent racks are located in the receiving groove; and the connecting portion further comprises a front hook portion and a rear hook portion respectively provided at two ends of the connecting portion in its length direction, and the front hook portion and the rear hook portion are configured to be detachably connected to transverse metal wires of the two adjacent racks, respectively; and the hook portion further comprises a lower hook portion provided at a second end thereof, and the lower hook portion is configured to receive the hanging rod.

Another object of the present application is to provide a shelving system which comprises:

a horizontal beam which is fixedly connected to a vertical surface;

a vertical beam which is slidably connected to the horizontal beam;

a bracket which is detachably connected to the vertical beam;

a rack which is provided on the bracket, is in contact with the bracket, and comprises a longitudinal metal wire;

a hook assembly which is connected to the rack; and a hanging rod which is connected to the hook assembly;

wherein the hook assembly comprises a connecting portion, the hook assembly is connected to the rack through the connecting portion, and the width of the connecting portion is larger than the spacing between adjacent longitudinal metal wires.

Another object of the present application is to provide a shelving system which comprises:

a horizontal beam which is fixedly connected to a vertical surface;

a vertical beam which is slidably connected to the horizontal beam;

a bracket which is detachably connected to the vertical beam;

at least two racks which are provided on the bracket, are in contact with the bracket, and comprise longitudinal metal wires, wherein the at least two racks are provided adjacently;

a hook assembly which is connected to a joint between the two adjacent racks; and a hanging rod which is connected to the hook assembly;

wherein the hook assembly comprises a connecting portion, and the hook assembly is respectively connected to the two adjacent racks through the connecting portion.

Another object of the present application is to provide a shelving system which comprises:

a bracket which is fixedly connected to a vertical surface;

a rack which is provided on the bracket, is in contact with the bracket, and comprises a longitudinal metal wire;

a hook assembly which is connected to the rack; and a hanging rod which is connected to the hook assembly;

wherein the hook assembly comprises a connecting portion, the hook assembly is connected to the rack through the connecting portion, and the width of the connecting portion is larger than the spacing between adjacent longitudinal metal wires.

Another object of the present application is to provide a shelving system which comprises:

a bracket which is fixedly connected to a vertical surface;

at least two racks which are provided on the bracket, are in contact with the bracket, and comprise longitudinal metal wires, wherein the at least two racks are provided adjacently;

a hook assembly which is connected to a joint between the two adjacent racks; and a hanging rod which is connected to the hook assembly;

wherein the hook assembly comprises a connecting portion, and the hook assembly is respectively connected to the two adjacent racks through the connecting portion.

Compared with the prior art, a hook assembly provided in the present application has at least the following technical advantages:

1. The hook assembly provided in the present application can be reliably connected to a densely gridded rack without reducing the width of a top plate, so as to avoid the interference from the longitudinal metal wires. Most of the sizes of the hook assembly remain unchanged, so as to solve the technical problems existing in the prior art with minimal modification and cost.
2. Compared with the prior art, with regard to the hook assembly provided in the present application, not only does it not need to reduce the width of the top plate, but it can also increase the width of the top when the top plate is provided with a plurality of receiving grooves, further increasing the load-bearing capacity of the hook assembly.
3. The hook assembly provided in the present application can be used as a connecting piece between two racks to increase the stability of the racks, thereby further improving the overall load-bearing capacity of the shelving system.

Hereinafter, the concept, specific structure and technical effects of the present application will be further illustrated in conjunction with the accompanying drawings, so as to fully understand the purposes, features and effects of the present application.

DETAILED DESCRIPTION OF THE PREFERRED EMBODIMENTS

Hereinafter, a plurality of preferred embodiments of the present application will be introduced with reference to the drawings attached to the specification, so that the technical content will be clearer and easier to understand. The present application can be embodied in many different forms of embodiments, and the scope of protection of the present application is not limited to the embodiments mentioned herein.

Figure 1:
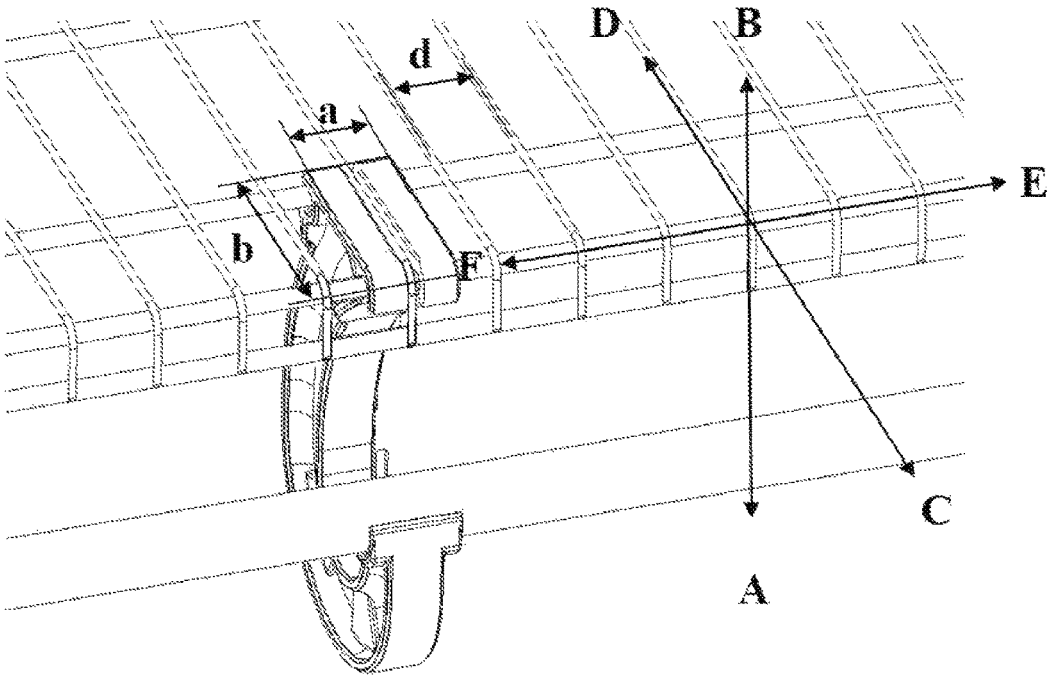
FIG. 1 is a schematic view of the definition of directions and sizes of the present application.

In the drawings, components with the same structure are represented by the same numerals, and components with similar structures or functions are represented by similar numerals. The size and thickness of each component shown in the drawings are arbitrarily shown, and the size and thickness of each component are not limited in the present application. In order to make the illustration clearer, the thicknesses of the components are appropriately exaggerated in some places in the drawings. The hook assembly provided in the present application is a part of the shelving assembly. Specifically, it is a hook assembly used in conjunction with a rack. As shown in FIG. 1, in the present application, "vertical directions" are same as or opposite to a natural gravity direction, that is, an arrow A points to a "vertical direction" downwards, and an arrow B points to a "vertical direction" upwards. "Horizontal directions" are natural horizontal directions, that is, directions indicated by arrows C, D, E, and F are all the "horizontal directions". In the horizontal directions, the directions pointed by the arrows E and F are "transverse directions", and the directions pointed by the arrows C and D are "longitudinal directions", wherein the direction pointed by the arrow C is toward a "front end", and the direction pointed by the arrow D is toward a "rear end". In the shelving assembly, the rack is composed of a plurality of metal wires provided in parallel along different directions interwoven. The metal wires provided along the transverse directions are "transverse metal wires", and the metal wires provided along the longitudinal directions are "longitudinal metal wires". The connecting portion of the hook assembly is substantially rectangular, wherein the size along the transverse direction is the "width", as shown in FIG. 1, a is the width a of the connecting portion; the size along the longitudinal direction is the "length", as shown in FIG. 1, b is the length b of the connecting portion; and as shown in FIG. 1, d is the spacing between adjacent longitudinal metal wires.

Embodiment 1

The structure view of this embodiment is shown in FIGS. 2-5. In this embodiment, there is provided a hook assembly comprising a connecting portion 101 and a hook portion 102. The connecting portion 101 is fixedly connected to the hook portion 102, and a first end 22 of the hook portion 102 is connected to the connecting portion 101. In this embodiment, in a normal use state, the connecting portion 101 is above the hook portion 102. The connecting portion 101 is an elongated rectangle, comprising a front hook portion 11, a rear hook portion 12 and a receiving groove 13. The front hook portion 11 and the rear hook portion 12 are respectively located at two ends of the connecting portion 101 along the length direction. Preferably, the front hook portion 11 is located at a front end of the connecting portion 101, and the rear hook portion 12 is located at a rear end of the connecting portion 101. The connecting portion 101 has a first surface 14, that is, the upper surface of the connecting portion 101. The first surface 14 is substantially a flat surface. The receiving groove 13 is a recessed groove provided on the first surface 14 of the connecting portion 101 along the length direction of the connecting portion 101. The receiving groove 13 crosses the first surface 14 along the length direction of the connecting portion 101. The hook portion 102 is curved and is "J" shaped as a whole. A first end 22 of the "J" shaped hook portion 102 is connected to the connecting portion 101, and a lower hook portion 21 is provided at a second end 23 of the "J" shaped hook portion 102.

Figure 2:
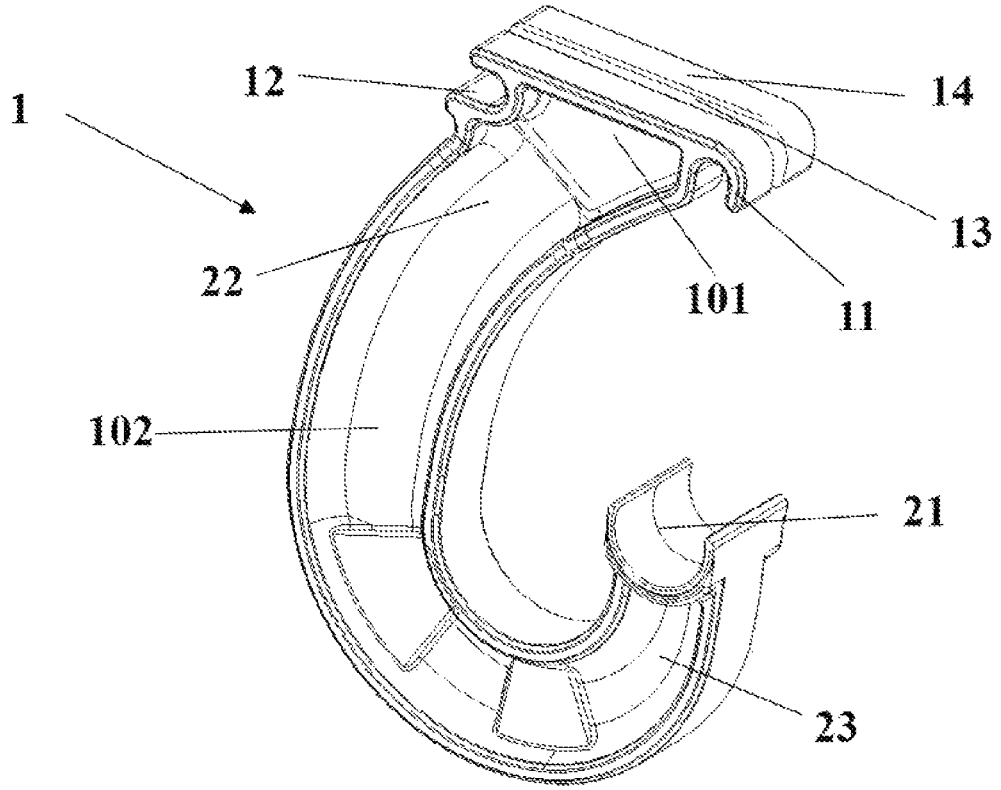
FIG. 2 is a schematic view of the overall structure of an embodiment of the present application.

As shown in FIG. 2, the front and rear sides of the second end 23 of the "J" shaped hook portion 102 each extend a certain distance to form the lower hook portion 21. The lower hook portion 21 is used to receive a hanging rod of a shelving assembly. The lower hook portion 21 has a lower hook portion opening, and preferably, the orientation of the lower hook portion opening is opposite to the orientation of the front hook portion 11, that is, upwards along the vertical direction as shown in the figure.

Figure 3:
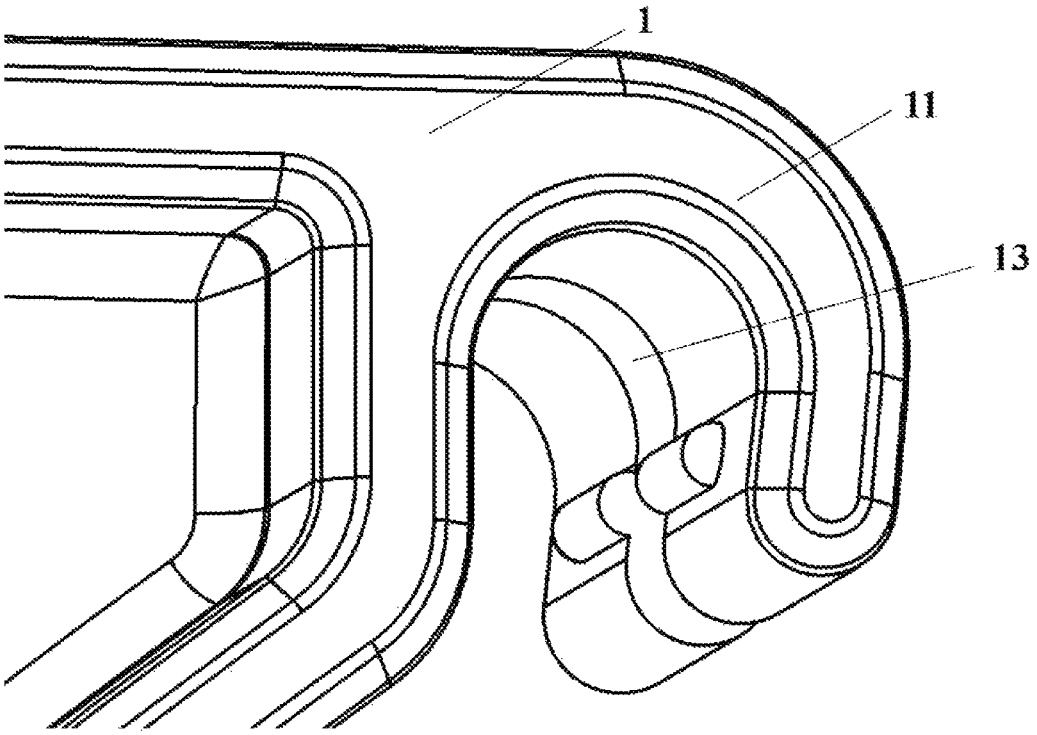
FIG. 3 is a partial enlarged schematic view of an embodiment of the present application.

As shown in FIG. 3, the receiving groove 13 extends from the first surface 14 along the front hook portion 11, dividing the front hook portion 11 into two parts.

Figure 4:
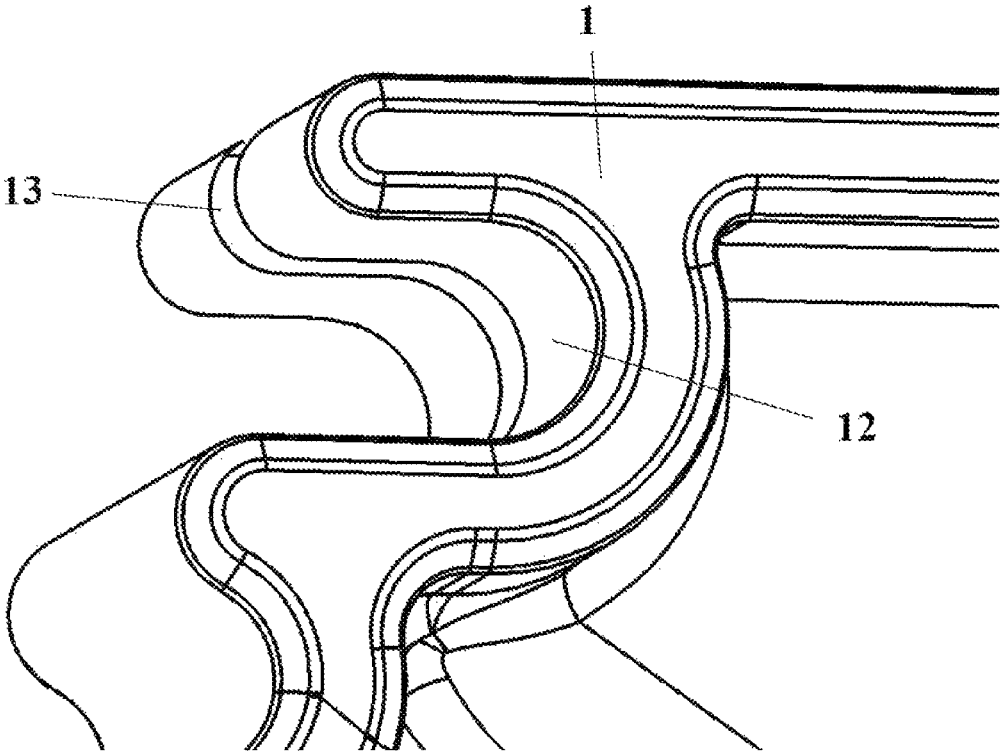
FIG. 4 is a partial enlarged schematic view of an embodiment of the present application.

As shown in FIG. 4, the receiving groove 13 extends from the first surface 14 along the rear hook portion 12, dividing the front hook portion 12 into two parts.

Figure 5:
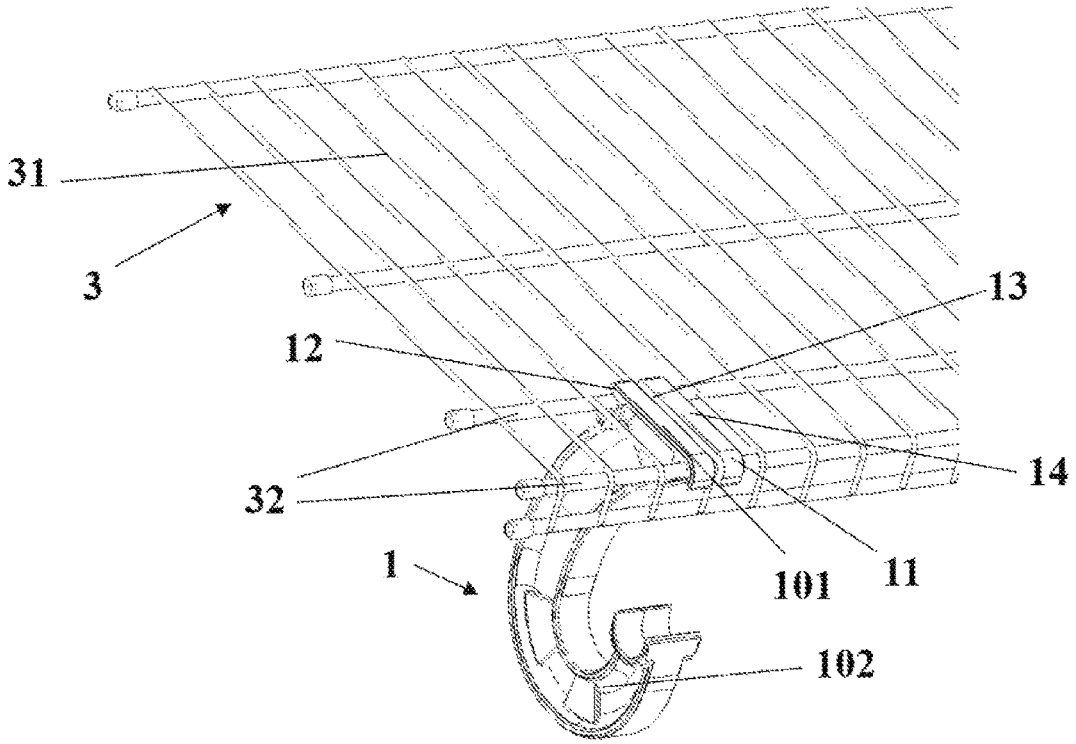
FIG. 5 is a schematic view of a connection relationship in a shelving assembly of an embodiment of the present application.

The connection relationship between the shelving system and other components in the shelf in this embodiment is shown in FIG. 5. A rack 3 is composed of multiple sets of transverse metal wires 32 provided in parallel and multiple sets of longitudinal metal wires 31 provided in parallel interwoven. In the prior art, the spacing between adjacent longitudinal metal wires 31 is relatively large, and the width a of the connecting portion 101 of the hook assembly is less than the spacing d between adjacent longitudinal metal wires 31. Therefore, the connecting portion 101 can pass between two longitudinal metal wires 31, and a connection between the hook assembly and the rack 3 is realized by the front hook portion 11 and the rear hook portion 12 receiving adjacent transverse metal wires 32. However, in some embodiments, it is necessary to reduce the spacing d between adjacent longitudinal metal wires 31, that is, to form a densely gridded rack 3, so as to increase the carrying capacity of the rack 3, or to prevent small-volume items from falling through a gap between longitudinal metal wires 31. For the densely gridded rack 3, the spacing d between adjacent longitudinal metal wires 31 of the rack is relatively small, which is less than the width a of the connecting portion 101 of a commonly used hook assembly. If a hook assembly 1 in the prior art is used, its connecting portion 101 cannot enter a gap between two adjacent longitudinal metal wires 31 of the rack 3 due to the interference of the longitudinal metal wires 31. If the width of the connecting portion 101 is reduced in order to match the smaller spacing d between the longitudinal metal wires 31, the strength of the entire hook assembly 1 will be affected, and its load-bearing capacity will be reduced. Under this premise, the receiving groove 13 provided on the upper surface of the connecting portion 101 can have an effect. When the hook assembly 1 is installed on the rack 3, the receiving groove 13 is placed in parallel with the longitudinal metal wires 31, and a longitudinal metal wire 31 is received in the receiving groove, so that the connecting portion 101 can pass through the rack 3 from bottom to top and will not be interfered by the longitudinal metal wires 31. The upper part of the rear hook portion 12 is located above a transverse metal wire 32, and the lower part of the rear hook portion 12 is located below the transverse metal wire 32, such that the transverse metal wire 32 is surrounded by the rear hook portion 12. Similarly, the front part of the front hook portion 11 is located in front of an adjacent transverse metal wire 2, and the rear part of the front hook portion 11 is located behind the transverse metal wire 32, such that the transverse metal wire 32 is surrounded by the front hook portion 11. The opening of the rear hook portion 12 is oriented backward, thus restricting a movement of the hook assembly in the vertical direction; and the opening of the front hook portion 11 is oriented downward, thus restricting a movement of the hook assembly in the longitudinal direction. When a longitudinal metal wire 31 is received in the receiving groove 13, the hook assembly is restricted from moving in the transverse direction. Therefore, when the front hook portion 11 and the rear hook portion 12 are matched with each other, and the spacing therebetween is substantially equal to the spacing between two adjacent transverse metal wires 32, the hook assembly can connect two transverse metal wires 32 and one longitudinal metal wire 31 at the same time, so that its position is completely limited and fixed relative to the rack 3. In order to achieve the best position-limiting effect, the diameter of a curve where the front hook portion 11 is located and the diameter of a curve where the rear hook portion 12 is located is set to match the diameter of the transverse metal wire 32, and the width and depth of the receiving groove 13 are set to match the diameter of the longitudinal metal wire 31.

The entire hook assembly is made of a material with certain elasticity. When the hook assembly needs to be removed from the rack, an external force may be exerted to toggle the front hook portion 11 or the rear hook portion 12, such that the transverse metal wire 32 is disengaged from the front hook portion 11 or the rear hook portion 12, thus eliminating the position-limiting on the hook assembly.

The lower hook portion 21 is used to receive the hanging rod 4. When two or more identical hook assemblies are installed at corresponding positions of the rack 3, the hook assemblies can receive one same hanging rod 4 to increase its load-bearing capacity. Preferably, the diameter of a curve where the lower hook portion 21 is located is set to match the diameter of the hanging rod 4.

In summary, FIG. 5 shows a shelving assembly comprising a rack 3 and a hook assembly 1. The hook assembly 1 is connected to the rack 3. The hook assembly 1 comprises a hook portion 102 and a connecting portion 101. One end of the hook portion 102 is fixedly connected to the connecting portion 101. A first surface 14 of the connecting portion 101 is provided with a receiving groove 13 along the length direction of the connecting portion 101. The receiving groove 13 is used to receive a longitudinal metal wire 31 of the rack 3. The connecting portion 101 further comprises a front hook portion 11 and a rear hook portion 12 respectively provided at two ends of the connecting portion in its length direction, and the front hook portion 11 and the rear hook portion 12 are respectively connected to transverse metal wires 32 provided adjacently on the rack 3.

Figure 7:
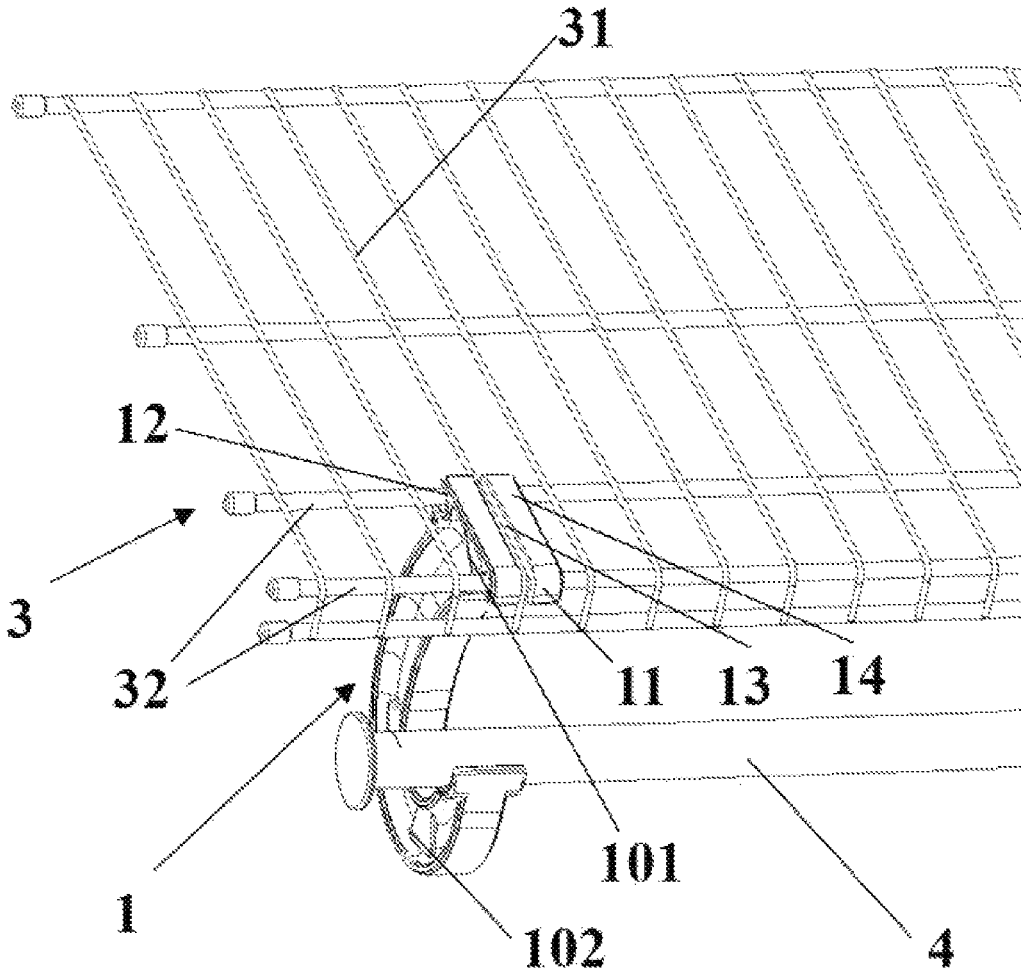
FIG. 7 is a schematic view of a connection relationship in a shelving assembly of an embodiment of the present application.

In other optional embodiments, it may also be a shelving assembly comprising a rack 3, a hanging rod 4, and a hook assembly 1, as shown in FIG. 7. The hook assembly 1 is connected to the rack 3, and the hanging rod 4 is connected to the hook assembly 1. The hook assembly 1 comprises a hook portion 102 and a connecting portion 101. One end of the hook portion 102 is fixedly connected to the connecting portion 101. A first surface 14 of the connecting portion 101 is provided with a receiving groove 13 along the length direction of the connecting portion 101. The receiving groove 13 is used to receive a longitudinal metal wire 31 of the rack 3. The connecting portion 101 further comprises a front hook portion 11 and a rear hook portion 12 respectively provided at two ends of the connecting portion in its length direction, and the front hook portion 11 and the rear hook portion 12 are respectively connected to transverse metal wires 32 provided adjacently on the rack 3. The hook portion 102 further comprises a lower hook portion 21 (as shown in FIG. 2) provided at a second end 23 thereof, and the lower hook portion 21 is configured to carry the hanging rod 4.

Figure 9:
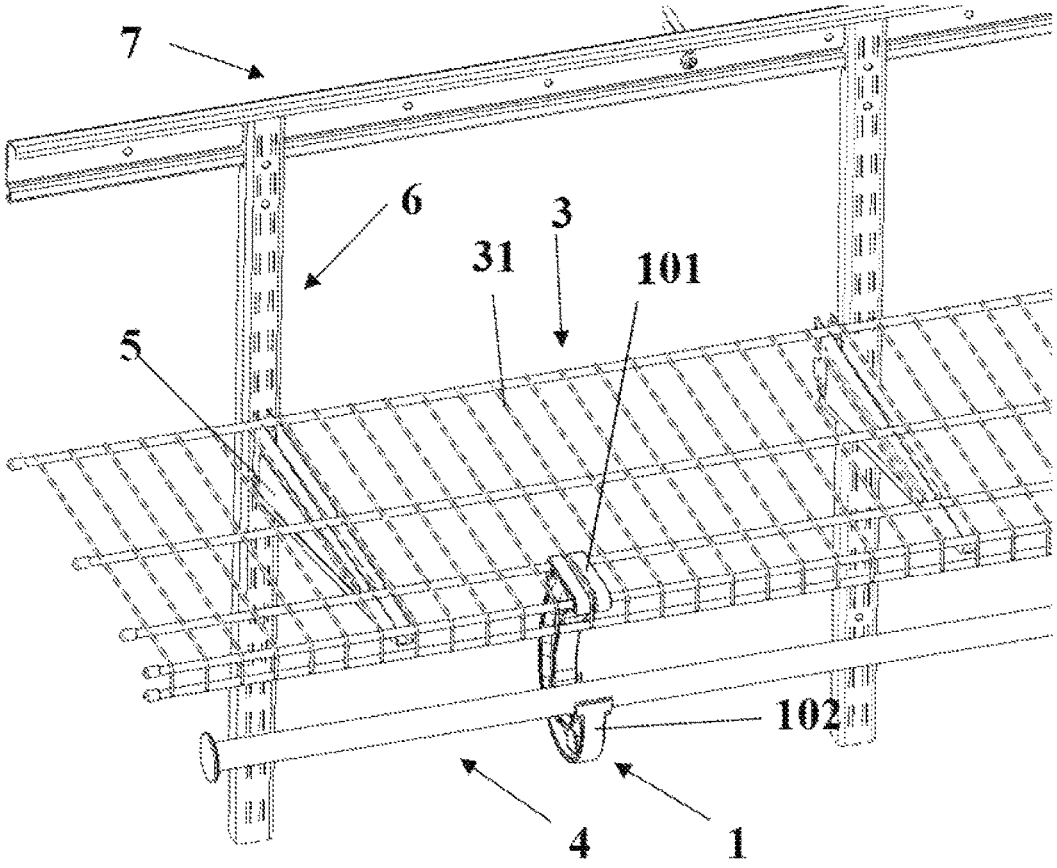
FIG. 9 is a schematic view of a connection relationship in a shelving assembly of an embodiment of the present application.

In other optional embodiments, it may also be a shelving assembly comprising a horizontal beam 7, a vertical beam 6, a bracket 5, a rack 3, a hanging rod 4, and a hook assembly 1, as shown in FIG. 9. The horizontal beam 7 is fixedly connected to a vertical surface; the vertical beam 6 is slidably connected to the horizontal beam 7; the bracket 5 is detachably connected to the vertical beam 6; the rack 3 is provided on the bracket 5 and is in contact with the bracket 5, and the rack 3 comprises longitudinal metal wires 31; the hook assembly 1 is connected to the rack 3; and the hanging rod 4 is connected to the hook assembly 1. The hook assembly 1 comprises a connecting portion 101, the hook assembly 1 is connected to the rack 3 through the connecting portion 101, and the width a of the connecting portion 101 is greater than the spacing d between adjacent longitudinal metal wires 31 (as shown in FIG. 1).

Figure 11:
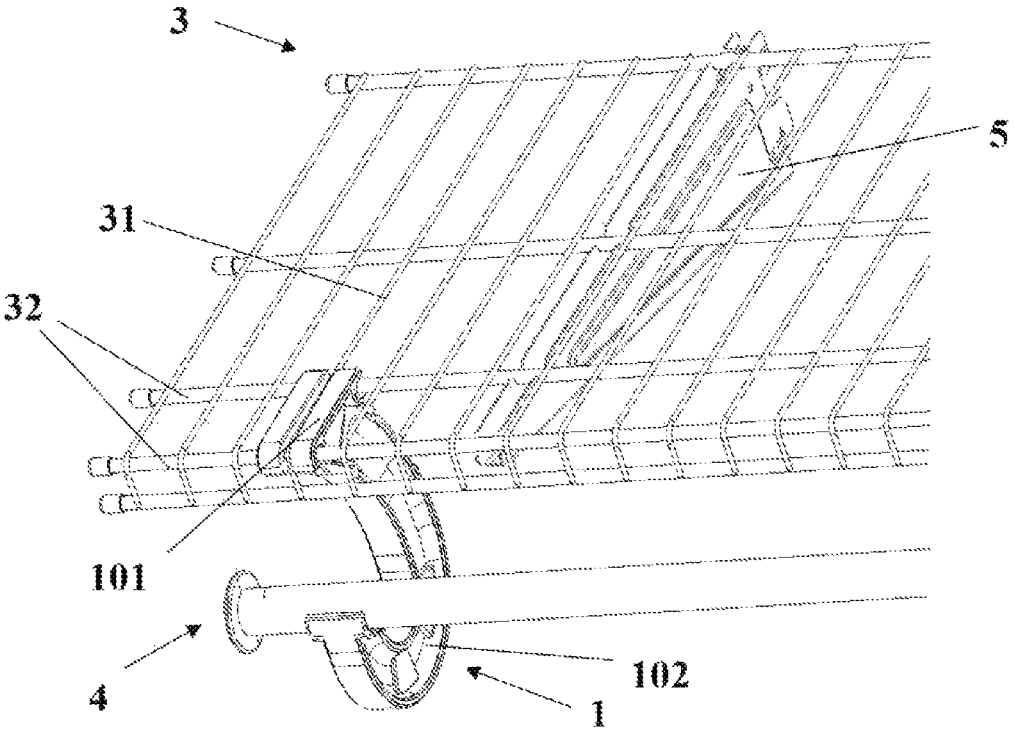
FIG. 11 is a schematic view of a connection relationship in a shelving assembly of an embodiment of the present application.

In other optional embodiments, it may also be a shelving assembly comprising a bracket 5, a rack 3, a hanging rod 4, and a hook assembly 1, as shown in FIG. 11. The bracket 5 is fixedly connected to a vertical surface; the rack 3 is provided on the bracket 5 and is in contact with the bracket 5, and the rack 3 comprises longitudinal metal wires 31; the hook assembly 1 is connected to the rack 3; and the hanging rod 4 is connected to the hook assembly 1. The hook assembly 1 comprises a connecting portion 101, the hook assembly 1 is connected to the rack 3 through the connecting portion 101, and the width a of the connecting portion 101 is greater than the spacing d between adjacent longitudinal metal wires 31 (as shown in FIG. 1).

Embodiment 2

In this embodiment, the structure of the hook portion 102 and the connection relationship between the hook portion 102 and the connecting portion 101 are the same as those in Embodiment 1, and will not be repeated here.

Figure 13:
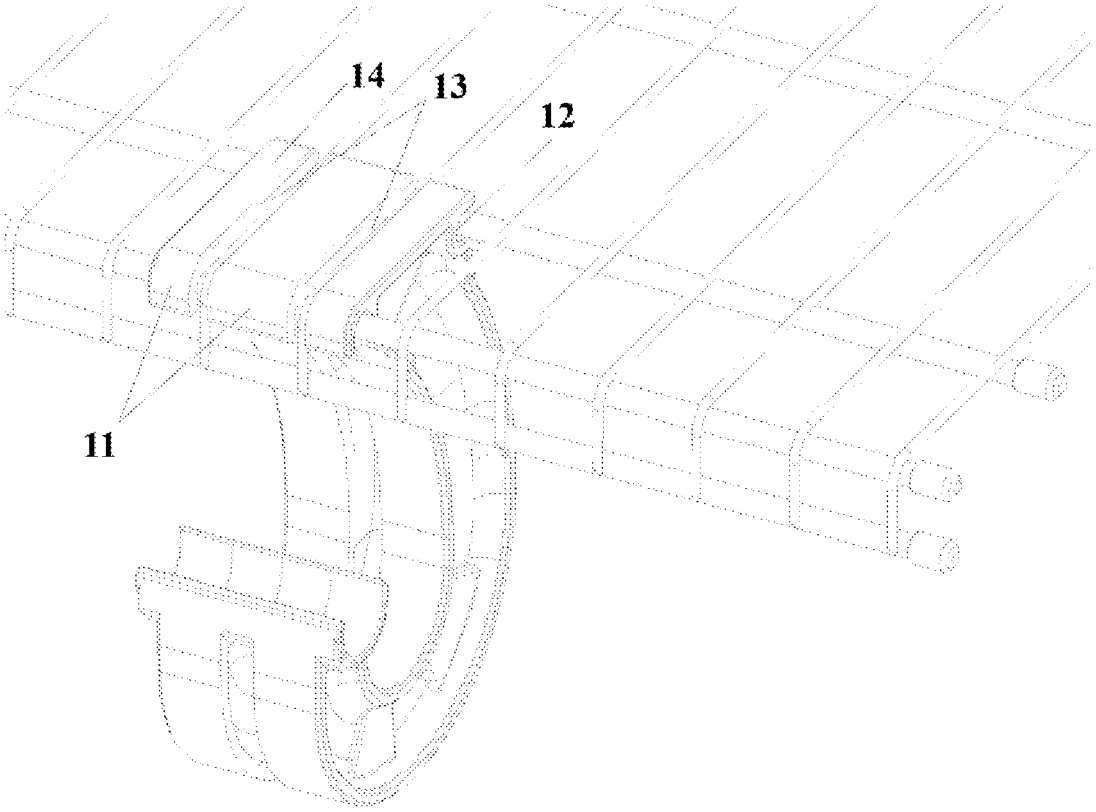
FIG. 13 is a schematic view of a connection relationship in a shelving assembly of an embodiment of the present application.

The difference between this embodiment and Embodiment 1 is that when there are further requirements for the load-bearing capacity of the hook assembly, the width of the connecting portion 101 may be increased to exceed the spacing between adjacent longitudinal metal wires 31 two times, or even three times or four times and so on. As shown in FIG. 13, it is only necessary to provide a plurality of parallel receiving grooves 13 on the upper surface of the connecting portion 101 to prevent the longitudinal metal wires 31 from interfering with the connecting portion 101 during installation. Preferably, the spacing between adjacent receiving grooves 13 is equal to the spacing between adjacent longitudinal metal wires 31. As in Embodiment 1, the width and depth of the receiving groove 13 are preferably set to be consistent with the diameter of the longitudinal metal wire 31, which can increase the strength of the hook assembly while achieving the best position-limiting effect.

Embodiment 3

Figure 6:
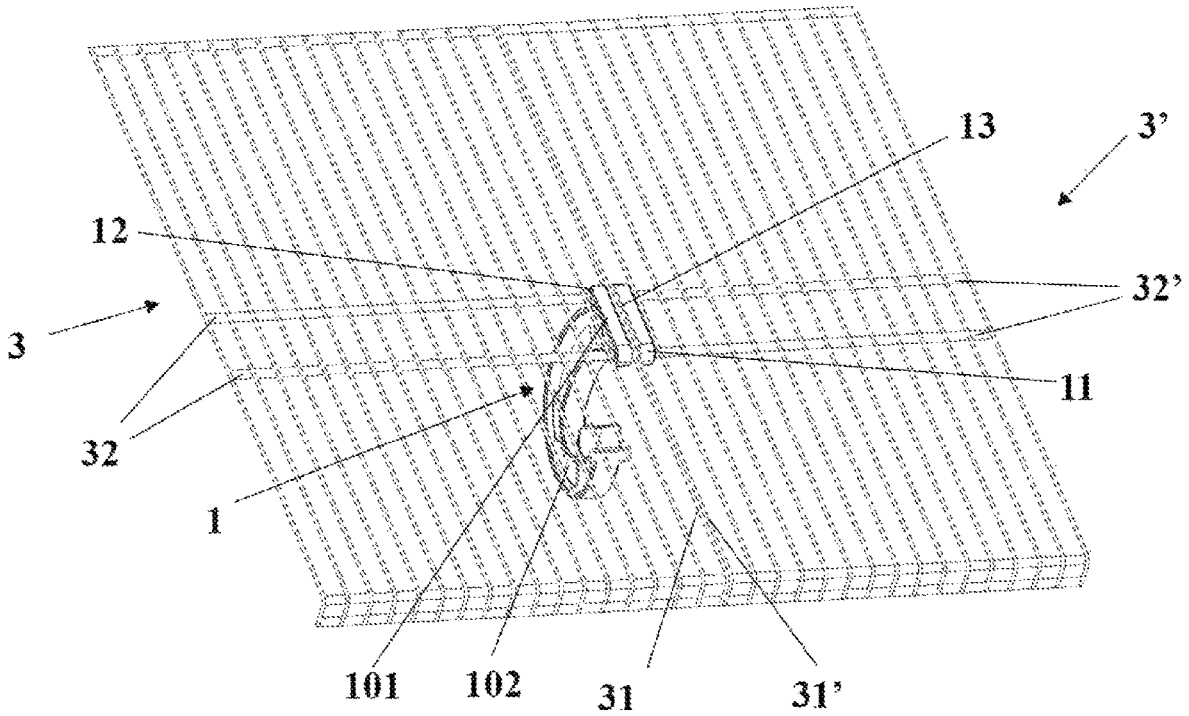
FIG. 6 is a schematic view of a connection relationship in a shelving assembly of an embodiment of the present application.

In some applications, the length of the rack 3 is not infinite, but a plurality of racks of a predetermined length are spliced together according to an actual need. As shown in FIG. 6, it is formed by splicing a first rack 3 and a second rack 3' together. Therefore, it is usually necessary to provide a connecting piece in the shelving system to ensure the stability of a splicing place of the rack.

In this embodiment, the structure of the connecting portion 101, the structure of the hook portion 102, and the connection relationship between the connecting portion 101 and the hook portion 102 are the same as those in the Embodiment 1, and will not be repeated here.

In this embodiment, the width of the receiving groove 13 on the connecting portion 101 is set to be able to receive two longitudinal metal wires 31 provided side by side. As shown in FIG. 6, specifically, the two longitudinal metal wires are respectively a longitudinal metal wire 31 located at the most edge of the first rack 3 and a longitudinal metal wire 31' at the most edge of the second rack 3'. The longitudinal metal wire 31 and the longitudinal metal wire 31' are provided adjacently in parallel, that is, the longitudinal metal wire 31 located at the most edge of the first rack 3 is provided adjacent to the second rack 3', and the longitudinal metal wire 31' at the most edge of the second rack 3' is provided adjacent to the first rack 3. More preferably, the width of the receiving groove 13 is equal to the sum of the diameters of the longitudinal metal wire 31 and the longitudinal metal wire 31'. Since the longitudinal metal wire 31 and the longitudinal metal wire 31' usually adopt the same diameter as other longitudinal metal wires 31, that is, the width of the receiving groove 13 is equal to twice the diameter of the longitudinal metal wire 31, the receiving groove 13 just receives two longitudinal metal wires provided side by side. When the two longitudinal metal wires 31, 31' are placed side by side in the receiving groove 13, due to the mutual position-limiting between side walls of the receiving groove 13 and the two longitudinal metal wires 31, 31', the connection between the two adjacent racks 3, 3' is stable. That is, the hook assembly itself becomes a connecting piece between two adjacent racks, so there is no need to additionally provide a rack connecting piece in the shelving system. In this embodiment, in order to allow the longitudinal metal wires 31, 31' belonging to two adjacent racks to be received in the receiving groove 13, at end positions, the transverse metal wires 32, 32' belonging to the two racks 3, 3' needs to be flush with the longitudinal metal wires 31, 31' at the most edge, so as to avoid mutual interference, which also do not reduce the welding strength between the racks 3, 3' at the same time.

In other similar embodiments, if the load-bearing capacity of the hook assembly needs to be increased, the width of the connecting portion 101 can be further increased. It is only necessary to provide a plurality of receiving grooves 13 at corresponding positions of a plurality of longitudinal metal wires 31 to achieve the same technical effect.

In summary, FIG. 6 shows a shelving assembly comprising at least two racks 3, 3' and a hook assembly 1, wherein the two racks 3, 3' are provided adjacently. The hook assembly 1 is connected to a joint between the two racks 3, 3'. The hook assembly 1 comprises a hook portion 102 and a connecting portion 101. One end of the hook portion 102 is fixedly connected to the connecting portion 101. A first surface 14 of the connecting portion 101 is provided with a receiving groove 13 along the length direction of the connecting portion 101. The receiving groove 13 is used to receive longitudinal metal wires 31, 31' of the racks 3, 3'. The connecting portion 101 further comprises a front hook portion 11 and a rear hook portion 12 respectively provided at two ends of the connecting portion in its length direction, and the front hook portion 11 and the rear hook portion 12 are detachably connected to transverse metal wires 32, 32' provided adjacently on the racks 3, 3', respectively.

Figure 8:
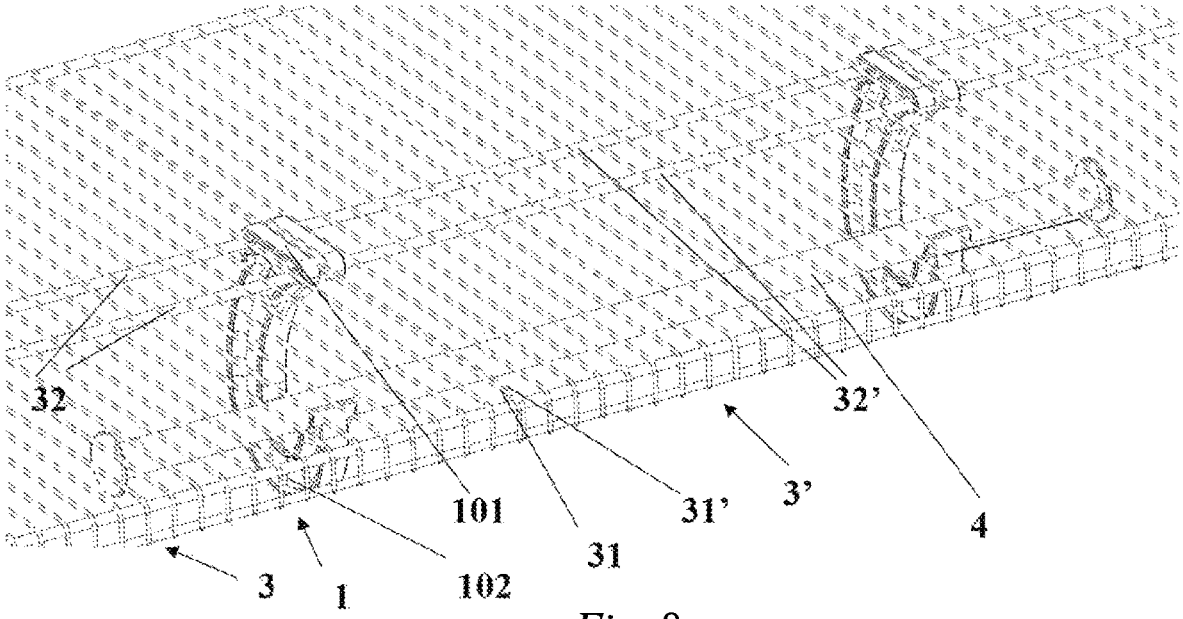
FIG. 8 is a schematic view of a connection relationship in a shelving assembly of an embodiment of the present application.

In other optional embodiments, it may also be a shelving assembly comprising at least two racks 3, 3', a hanging rod 4, and a hook assembly 1, wherein the two racks 3, 3' are provided adjacently, as shown in FIG. 8. The hook assembly 1 is connected to a joint between the two racks 3, 3'. The hanging rod 4 is connected to the hook assembly 1. The hook assembly 1 comprises a hook portion 102 and a connecting portion 101. One end of the hook portion 102 is fixedly connected to the connecting portion 101. A first surface 14 of the connecting portion 101 is provided with a receiving groove 13 along the length direction of the connecting portion 101. The receiving groove 13 is used to receive longitudinal metal wires 31, 31' of the racks 3, 3'. The connecting portion 101 further comprises a front hook portion 11 and a rear hook portion 12 respectively provided at two ends of the connecting portion in its length direction, and the front hook portion 11 and the rear hook portion 12 are detachably connected to transverse metal wires 32, 32' provided adjacently on the racks 3, 3', respectively. The hook portion 102 further comprises a lower hook portion 21 (as shown in FIG. 2) provided at a second end 23 thereof, and the lower hook portion 21 is configured to receive the hanging rod 4.

Figure 10:
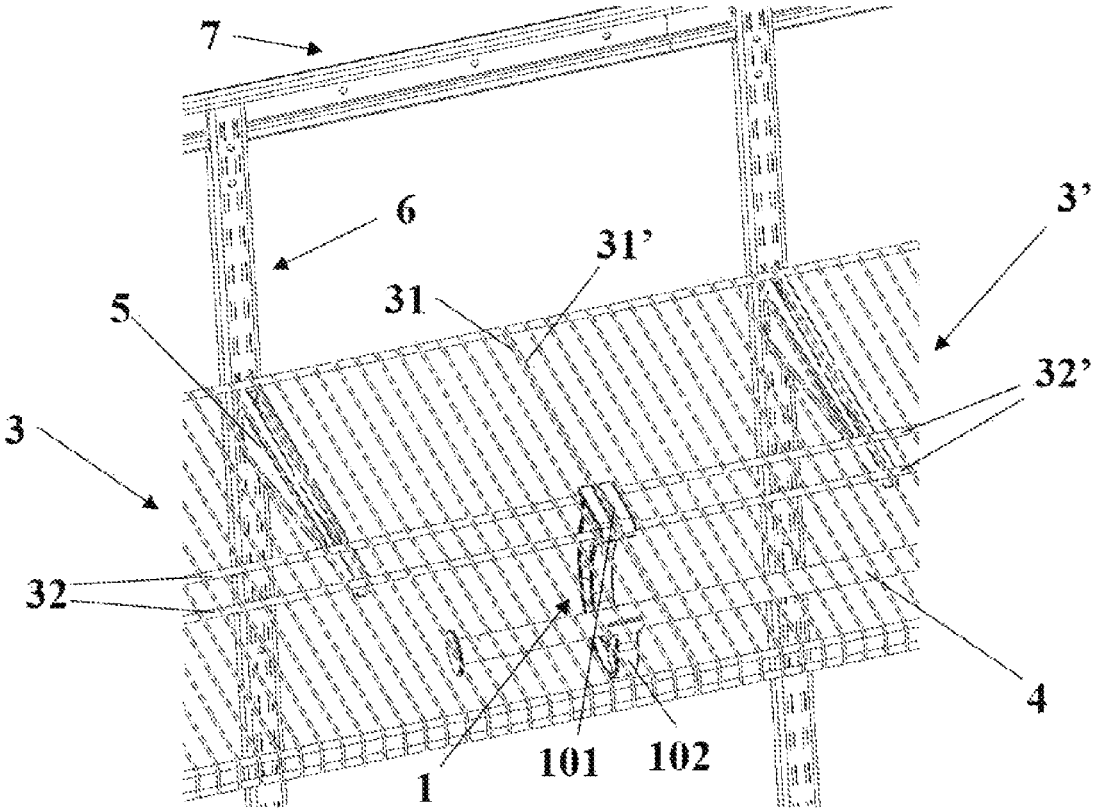
FIG. 10 is a schematic view of a connection relationship in a shelving assembly of an embodiment of the present application.

In other optional embodiments, it may also be a shelving assembly comprising a horizontal beam 7, a vertical beam 6, a bracket 5, two racks 3, 3' provided adjacently, a hanging rod 4, and a hook assembly 1, as shown in FIG. 10. The horizontal beam 7 is fixedly connected to a vertical surface; the vertical beam 6 is slidably connected to the horizontal beam 7; the bracket 5 is detachably connected to the vertical beam 6; the racks 3, 3' are provided on the bracket 5 and are in contact with the bracket 5, and the racks 3, 3' comprise longitudinal metal wires 31, 31'; the hook assembly 1 is connected to a joint between the two racks 3, 3'; and the hanging rod 4 is connected to the hook assembly 1. The hook assembly 1 comprises a connecting portion 101, and the hook assembly 1 is connected to the rack 3 through the connecting portion 101. The hook assembly 1 is respectively connected to the two racks 3, 3' provided adjacently through the connecting portion 101.

Figure 12:
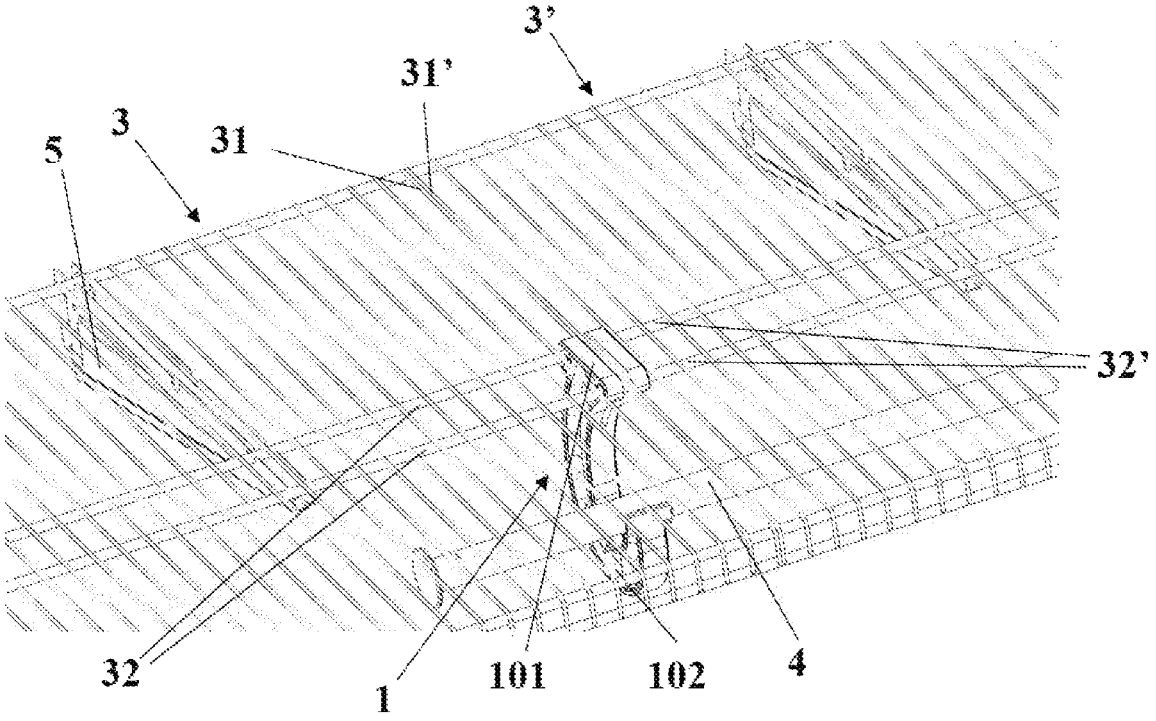
FIG. 12 is a schematic view of a connection relationship in a shelving assembly of an embodiment of the present application.

In other optional embodiments, it may also be a shelving assembly comprising a bracket 5, at least two racks 3, 3' provided adjacently, a hanging rod 4, and a hook assembly 1, as shown in FIG. 12. The bracket 5 is fixedly connected to a vertical surface; the racks 3, 3' are provided on the bracket 5 and are in contact with the bracket 5, the racks 3 comprise longitudinal metal wires 31, 31'; the hook assembly 1 is connected to the rack 3; and the hanging rod 4 is connected to the hook assembly 1. The hook assembly 1 comprises a connecting portion 101, and the hook assembly 1 is connected to a joint between the two racks 3, 3'. The hanging rod 4 is connected to the hook assembly 1. The hook assembly 1 comprises a connecting portion 101, and the hook assembly 1 is connected to the rack 3 through the connecting portion 101. The hook assembly 1 is respectively connected to the two racks 3, 3' provided adjacently through the connecting portion 101.

It should be noted that the plurality of embodiments mentioned above only represent a few typical representatives of the present invention, but they should not be understood as a limitation on the scope of the invention patent. Other embodiments obtained through simple replacements and modifications fall within the scope of protection of the present invention. Various technical features of the above-mentioned embodiments can be combined arbitrarily. In order to make the description concise, all possible combinations of the various technical features in the above-mentioned embodiments are not described. However, as long as there is no contradiction in the combinations of these technical features, all of the combinations shall be considered to fall within the scope of the specification.

The preferred embodiments of the present application are described in detail above. It should be understood that those of ordinary skills in the art may make many modifications and changes according to the concept of the present application without creative work. Therefore, all technical solutions that can be obtained by those skilled in the art through logical analysis, reasoning or limited experiments based on the concept of the present application and the prior art should fall within the scope of protection defined by the claims.

The invention claimed is:

1. A hook assembly, comprising a hook portion and a connecting portion, wherein a first end of the hook portion is fixedly connected to the connecting portion, and the connecting portion is configured to be detachably connected to a rack;

wherein a front end of the connecting portion is provided with a front hook portion, and a rear end of the connecting portion is provided with a rear hook portion;

wherein the front hook portion is provided with a first recess for receiving a first transverse metal wire of the rack; the rear hook portion is provided with a second recess facing backwards for receiving a second transverse metal wire rearwardly disposed adjacent to the first transverse metal wire.

2. The hook assembly of claim 1, wherein the width of the connecting portion is greater than the spacing between adjacent longitudinal metal wires of the rack.

3. The hook assembly of claim 1, wherein an upper surface of the connecting portion is provided with a receiving groove, the receiving groove crosses the upper surface of the connecting portion along a length direction of the connecting portion, and the receiving groove is configured to receive a longitudinal metal wire of the rack.

4. The hook assembly of claim 3, wherein the size of the receiving groove matches the diameter of the longitudinal metal wire.

5. The hook assembly of claim 4, wherein there are a plurality of the receiving grooves and their sizes match the longitudinal metal wire, and the spacing between adjacent receiving grooves is equal to the spacing between adjacent longitudinal metal wires.

6. The hook assembly of claim 3, wherein the width of the receiving groove is greater than twice the diameter of the longitudinal metal wire.

7. The hook assembly of claim 3, wherein the receiving groove extends along the front hook portion of the connecting portion, dividing the front hook portion into two parts.

8. The hook assembly of claim 3, wherein the receiving groove extends along the rear hook portion of the connecting portion, dividing the rear hook portion into two parts.

9. The hook assembly of claim 1, wherein the first recess faces downwards, the front hook portion is divided into a front half part and a rear half part by the first recess, the front half part is located in front of the first transverse metal wire, and the rear half part is located behind the first transverse metal wire, such that the first transverse metal wire is received by the front hook portion.

10. The hook assembly of claim 1, wherein the rear hook portion is divided into an upper half part and a lower half part by the second recess, the upper half part is located above the second transverse metal wire, and the lower half part is located below the second transverse metal wire, such that the second transverse metal wire is received by the rear hook portion.

11. A shelving system comprising a first rack, a second rack and a hook assembly, wherein the hook assembly comprises a connecting portion and a hook portion, wherein the connecting portion is fixedly connected to a first end of the hook portion, and the connecting portion is configured to be provided at a joint between the first rack and the second rack provided adjacently;

wherein a front end of the connecting portion is provided with a front hook portion, and a rear end of the connecting portion is provided with a rear hook portion;

wherein the front hook portion is provided with a first recess for receiving a first transverse metal wire of the rack; the rear hook portion is provided with a second recess facing backwards for receiving a second transverse metal wire rearwardly disposed adjacent to the first transverse metal wire;

wherein an upper surface of the connecting portion is provided with a receiving groove, the receiving groove is provided along a length direction of the connecting portion and crosses the upper surface of the connecting portion, and the receiving groove is configured to receive a first longitudinal metal wire, which is adjacent to the second rack, on the first rack, and a second longitudinal metal wire, which is adjacent to the first rack, on the second rack.

12. The shelving system of claim 9, wherein the depth of the receiving groove matches the diameters of the first longitudinal metal wire and the second longitudinal metal wire.

13. The shelving system of claim 11, wherein the width of the receiving groove is greater than the sum of the diameter of the first longitudinal metal wire and the diameter of the second longitudinal metal wire.

14. A shelving system, comprising:

a horizontal beam which is fixedly connected to a vertical surface;

a vertical beam which is slidably connected to the horizontal beam;

a bracket which is detachably connected to the vertical beam;

a rack which is provided on the bracket, is in contact with the bracket, and comprises a longitudinal metal wire;

a hook assembly which is connected to the rack; and a hanging rod which is connected to the hook assembly;

wherein the hook assembly comprises a connecting portion and a hook portion and, wherein a first end of the hook portion is fixedly connected to the connecting portion, and the connecting portion is configured to be detachably connected to the rack;

wherein a front end of the connecting portion is provided with a front hook portion, and a rear end of the connecting portion is provided with a rear hook portion;

wherein the front hook portion is provided with a first recess for receiving a first transverse metal wire of the rack; the rear hook portion is provided with a second recess facing backwards for receiving a second transverse metal wire rearwardly disposed adjacent to the first transverse metal wire.

15. The shelving system of claim 14, wherein the width of the connecting portion is greater than the spacing between adjacent longitudinal metal wires of the rack.

16. The shelving system of claim 14, wherein an upper surface of the connecting portion is provided with a receiving groove, the receiving groove crosses the upper surface of the connecting portion along a length direction of the connecting portion, and the receiving groove is configured to receive a longitudinal metal wire of the rack.

17. The shelving system of claim 16, wherein the size of the receiving groove matches the diameter of the longitudinal metal wire.

18. The shelving system of claim 17, wherein there are a plurality of the receiving grooves and their sizes match the longitudinal metal wire, and the spacing between adjacent receiving grooves is equal to the spacing between adjacent longitudinal metal wires.

19. The shelving system of claim 18, wherein the width of the receiving groove is greater than twice the diameter of the longitudinal metal wire.

20. The shelving system of claim 16, wherein the receiving groove extends along the front hook portion of the connecting portion, dividing the front hook portion into two parts.

* * * * *